US005851448A

United States Patent [19]

Tyer

[11] Patent Number: 5,851,448

[45] Date of Patent: Dec. 22, 1998

[54] SINGLE GUIDE MEMBER RETRIEVABLE AERATION SYSTEM

[75] Inventor: Robert R. Tyer, Willis, Tex.

[73] Assignee: AerResearch, Inc., Humble, Tex.

[21] Appl. No.: 977,571

[22] Filed: Nov. 25, 1997

Related U.S. Application Data

[63] Continuation-in-part of Ser. No. 746,299, Nov. 8, 1996, Pat. No. 5,690,864, which is a continuation-in-part of Ser. No. 664,405, Jun. 17, 1996, abandoned.

[51] Int. Cl.[6] ..... B01F 3/04

[52] U.S. Cl. ..... 261/122.1; 261/DIG. 47

[58] Field of Search ..... 261/120, 122.1, 261/122.2, 124, DIG. 47, DIG. 70

[56] References Cited

U.S. PATENT DOCUMENTS

| | | | |
|---|---|---|---|
| 2,502,187 | 3/1950 | Wahlgren | 261/122.1 |
| 2,650,810 | 9/1953 | Nordell | 261/DIG. 47 |
| 3,160,685 | 12/1964 | Chase | 261/DIG. 47 |
| 3,880,965 | 4/1975 | Dudis et al. | 261/122.1 |
| 4,273,732 | 6/1981 | Roediger | 261/DIG. 47 |
| 4,563,277 | 1/1986 | Tharp | 261/122.1 |
| 4,820,457 | 4/1989 | Jager | 261/122.2 |
| 5,290,487 | 3/1994 | Ludwig | 261/122.1 |
| 5,587,114 | 12/1996 | Tharp | 261/DIG. 47 |
| 5,690,864 | 11/1997 | Tyer | 261/122.1 |

*Primary Examiner*—C. Scott Bushey
*Attorney, Agent, or Firm*—Daniel V. Thompson

[57] ABSTRACT

An aeration system for a wastewater treatment plant includes an air supply pipe for receiving compressed air. The air supply pipe has a plurality of outlets, with a flexible air supply conduit extending from each outlet to an elongated aerator. An end fitting is included in the aerator at each end. Each end fitting has a fastener defining an attachment location. A yoke is longer than the aerator and has two ends, one end fixed to each attachment location. The yoke also has a central yoke ring, which is loosely interfitted with a guide member to permnit relative movement between the aerator and guide member. The lower end of the guide member is fixed with respect to the bottom of the wastewater treatment basin. An upper end of the guide member is attached to a stop member, and a spacer is provided for positioning the aerator away from the stop member at the top of each guide member.

7 Claims, 4 Drawing Sheets

SINGLE GUIDE MEMBER RETRIEVABLE AERATION SYSTEM

CROSS REFERENCE TO RELATED APPLICATION

This application is a continuation-in-part of U.S. Ser. No. 08/746,299, filed Nov. 8, 1996, (now U.S. Pat. No. 5,690,864), which was a continuation-in-part of U.S. Ser. No. 08/664,405, filed Jun. 17, 1996, (now abandoned).

TECHNICAL FIELD

This application relates to aeration systems for wastewater treatment plants.

BACHROUND OF THE INVENTION

Tubular fine-bubble diffusers offer several advantages over circular disk diffusers. These advantages include oxygen transfer efficiency and mechanical advantages. Typically a tubular fine-bubble diffuser has a perforated membrane supported by a tubular membrane support.

The primary mechanical advantage of tubular diffusers is that they can be mounted under the air supply pipe so that they are the low point in the system. This allows water to be removed continuously through the membrane so that no separate water removal system is required. Disk diffusers are typically mounted above the pipe so that water that enters the system has no way to get out. Separate water removal systems must be provided when disk diffusers are used. In addition, tubular diffusers can be mounted adjacent to the floor, and this additional submergence optimizes mixing and oxygen transfer.

At the proper air flow rate, tubular diffusers meet or exceed the oxygen transfer efficiency of disk diffusers. Tubular diffusers are not as affected by the chimney effect which reduces transfer efficiency by bringing bubbles into close contact with one another at a point above the diffuser. It is this chimney effect that has been the subject of so much discussion about maximum size of disk diffusers. Many experts agree that the optimum diameter for disk diffusers is less than one foot. The length of tubular diffusers has no limit other than structural.

Tubular diffusers achieve as high a transfer efficiency as disk diffusers, and, because they are less affected by the chimney effect, they can be used over a wider range of air flows. The transfer efficiency of tubular diffusers is relatively independent of their diameter and is, for the most part, a function of the air flow per unit of length.

The primary reason that the advantages of tubular diffusers have not been applied is that the weakness of their mounting systems limits their length to approximately twenty-four to thirty-six inches. This makes it difficult to get enough tubes in the basin to use the low air flow rates required to get high transfer efficiency. The result is usually a cluster of tubes which act as a single point source—essentially like a disk diffuser.

Thus, there presently exists a need for a system that will enable the use of long tubular diffusers, which will solve this problem by avoiding the effect of clustering tubes.

SUMMARY OF THE INVENTION

An aeration system for a wastewater treatment plant includes an air supply pipe for receiving compressed air. The air supply pipe has a plurality of outlets, with a flexible air supply conduit extending from each outlet to an elongated aerator. An end fitting is included in the aerator at each end. Each end fitting has a fastener defining an attachment location. A yoke is longer than the aerator and has two ends, one end fixed to each attachment location. The yoke also has a central yoke ring, which is loosely interfitted with a guide member to permit relative movement between the aerator and guide member. The lower end of the guide member is fixed with respect to the bottom of the wastewater treatment basin. An upper end of the guide member is attached to a stop member, and a spacer is provided for positioning the aerator away from the stop member at the top of each guide member.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
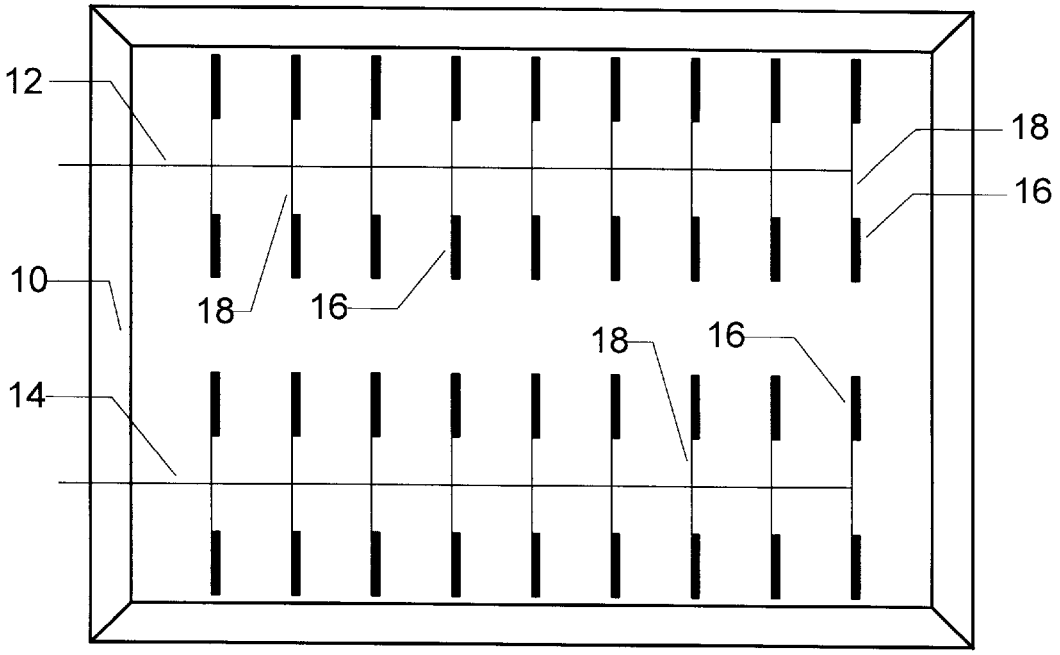
FIG. 1 is a schematic plan view of a first embodiment of the invention.

Referring initially to FIG. 1, a wastewater treatment plant includes a wastewater treatment basin 10. While basin 10 is illustrated as being rectangular, with sloping side walls, it will be recognized that the system of this invention is useful in many other configurations of basins. An air supply pipe 12 receives compressed air from a source of compressed air (not shown), as does air supply pipe 14. Each air supply pipe 12, 14 supplies air to a plurality of elongate aerators 18 through flexible air supply conduits 19.

Figure 2:
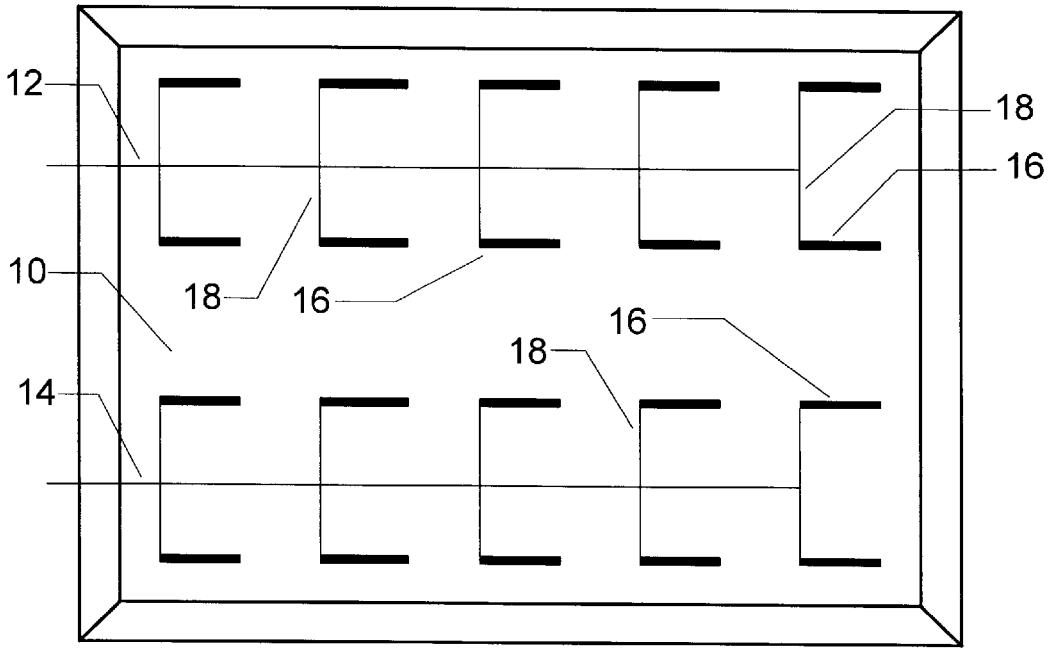
FIG. 2 is an alternate to the embodiment of FIG. 1, also shown in schematic plan view.

FIG. 2 illustrates an alternate layout, where elongate aerators 18 are parallel to the air supply pipes 12, 14. In FIG. 1, aerators 18 are perpendicular to the air supply pipes 12, 14. The particular layout is a matter of design choice, as is well known to one skilled in the art.

Referring now to FIGS. 3–6, where like numerals indicate like and corresponding elements, the details of the system of this invention may be understood.

Figure 3:
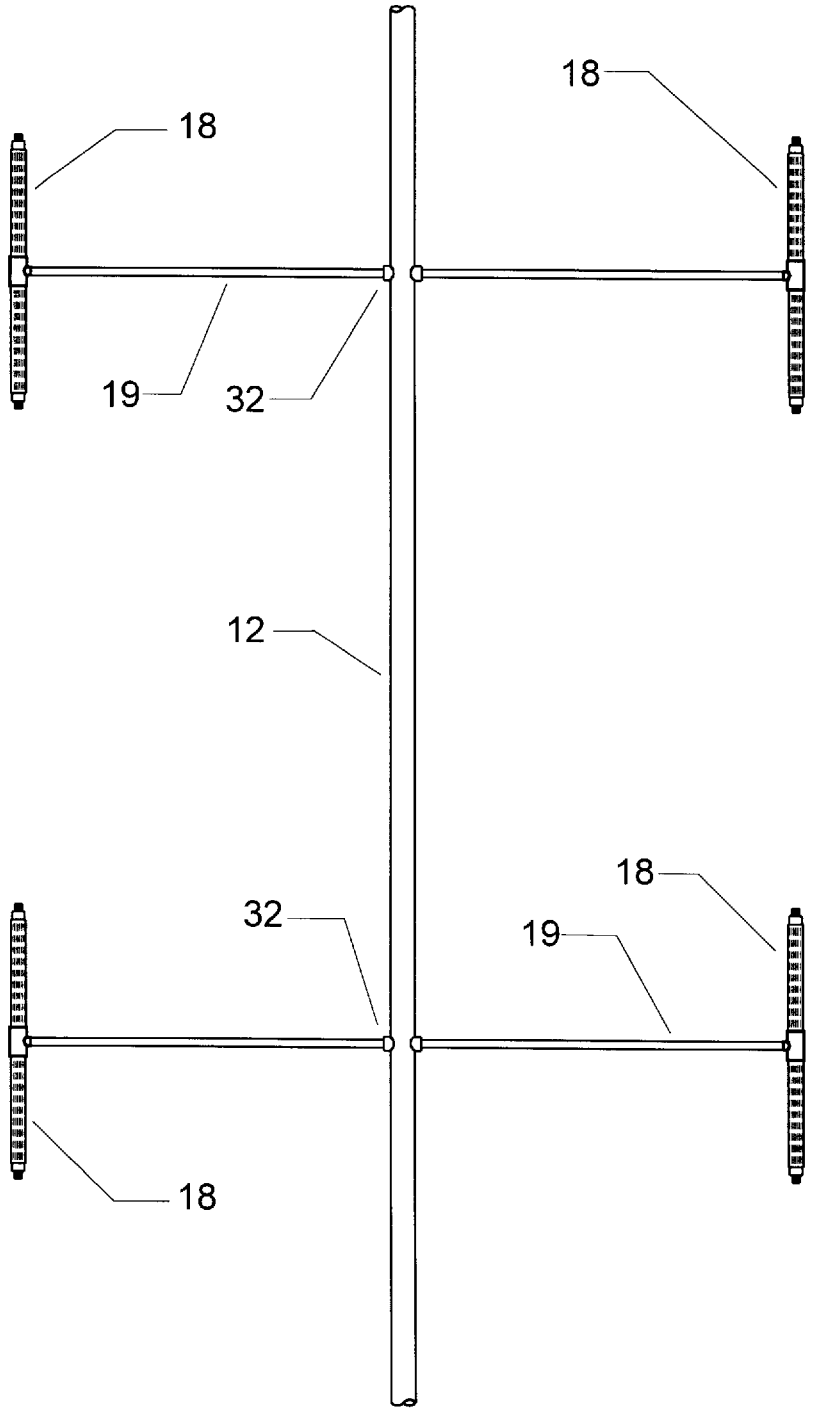
FIG. 3 is partial plan view illustrating the system of the present invention in more detail.
Figure 4:
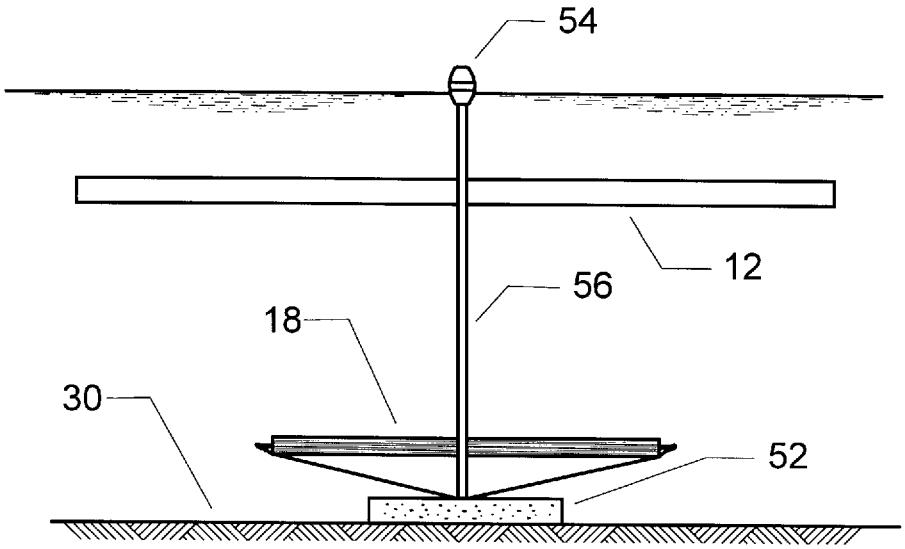
FIG. 4 is a side view of the system of FIG. 3.
Figure 5:
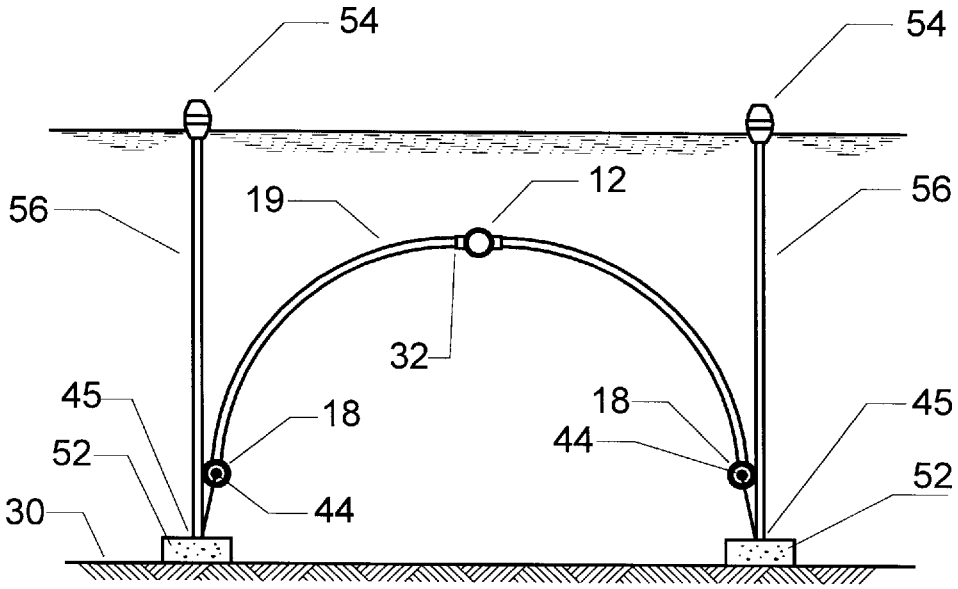
FIG. 5 is a side view similar to FIG. 4, rotated 90 degrees.
Figure 6:
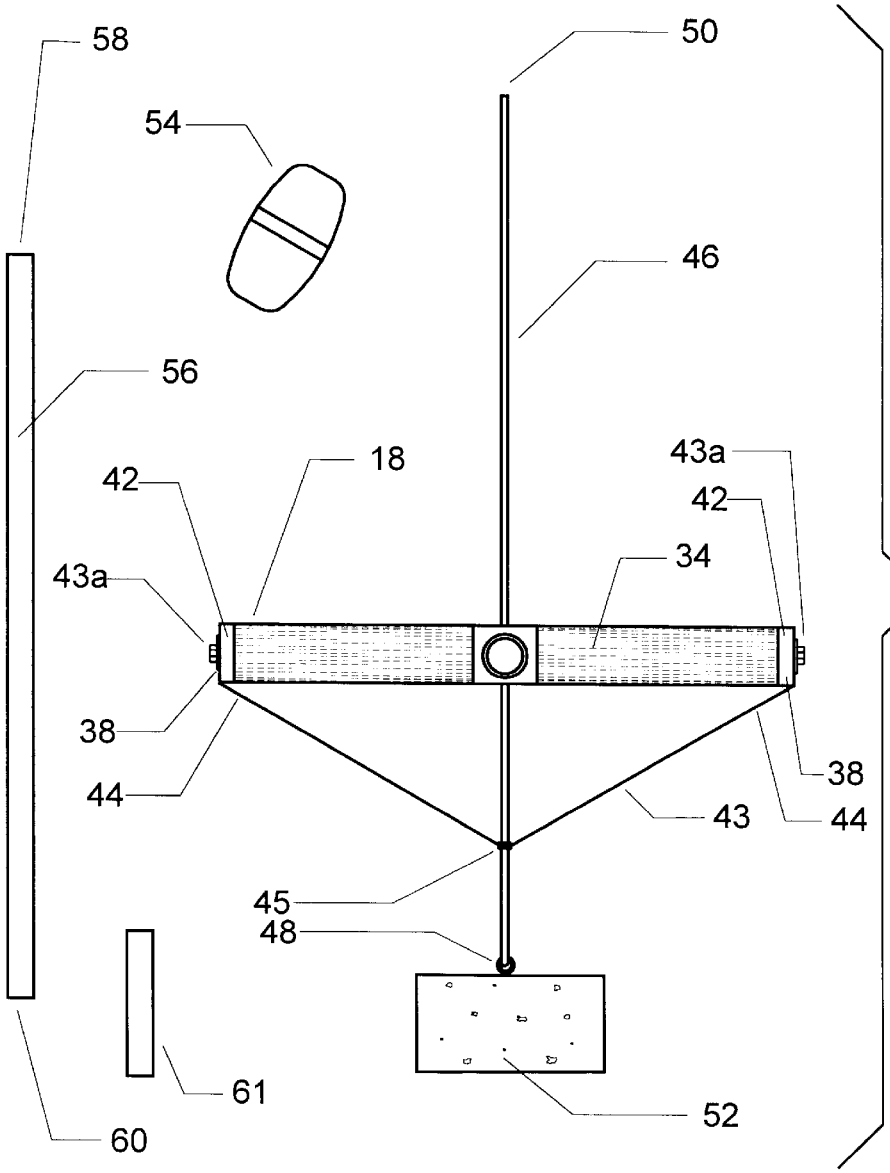
FIG. 6 is an exploded view illustrating components of the guide member, spacer and stop member.

The aeration system includes a horizontal air supply pipe or "lateral" for receiving compressed air designated by the numeral 12. The air supply lateral is vertically spaced-apart from floor 30 of the wastewater treatment basin, although alternate vertical positionings are possible. Lateral 12 has a plurality of outlets formed by saddle branches 32 (FIGS. 3 and 5, not shown in FIG. 4).

Long, flexible, aerator conduits or "feedlines" 19 extend from each outlet 32 to an aerator 18. Preferably, as disclosed in my U.S. Pat. No. 5,690,864, the disclosure of which is incorporated by reference, each aerator 18 includes a membrane support tube and a perforated membrane 34. The membrane 34 is sleeved over the membrane support tube, and the membrane 34 has ends sealed to the membrane support tube by way of clamps or the like. The membrane support tube has walls defining at least one air aperture to supply air to the membrane 34 between the ends.

An end fitting 42 is located at each end 38 of the aerator 18. A fastener 43*a* in each end fitting 42 defines an attachment location. Yoke 43 is longer than aerator 18 and has two ends 44, one end 44 fixed to each attachment location. The yoke also has a central yoke ring 45.

A guide member 46 is provided for yoke ring 45. The guide member has lower and upper ends 48,50. In the preferred embodiment, guide member 46 is a flexible rope, however, many alternate forms of a guide member may be used such as tubes, rods, cables and even guide channels fixed to basin walls. Guide member 46 is loosely interfitted with yoke ring 45. The preferred attachment location is provided by a fastener 43*a* connected to end 44 of yoke 43, and the preferred connection between yoke cable 43 and guide member 46 is a central ring on the yoke around a rope, however, many alternate forms of a loosely interfitting attachments are available. The essential feature is that relative movement between the aerator and the guide member is provided.

Lower end 48 is fixed with respect to the basin floor 30. Preferably, an aerator ballast block 52 provides the fixed attachment, however, other means of attachment are possible. Upper end 50 of guide member 46 is attached to a stop member 54, which preferably includes a float removably attached to a loop by a clip, but stop member 54 may be provided in many alternate forms.

A spacer 56 is provided for each end of the aerator. Spacer 56 has upper and lower ends 58, 60. The upper end 58 contacts stop member 54, and the lower end contacts yoke ring 45 when aerator 18 has positive buoyancy, i.e., when the system is in operation and the aerator is full of air. Thus, aerator 18 by way of yoke 43 is positioned downwardly away from stop member 54 by the spacer 56. In the preferred embodiment, spacer 56 is a tube that is slipped over rope 46, however, equivalent forms of this structure will be apparent. Aerator 18 is repositionable by removing spacer 56 from guide member 46, or by changing the length of spacer 56. In operation, aerator 18 has positive buoyancy and raises to the height established by the length of guide member 46 less the length of spacer 56.

An optional bottom spacer 61 may also be provided in some installations, where aerator 18 is not desired to be at the lowest possible submerged location and spacing above the bottom is desired when the aerator has negative buoyancy. In some instances, it is desirable to space the aerator 18 from the bottom of the basin when the system is out of operation and no compressed air is being supplied. Bottom spacer 61 need not extend the entire distance between the aerator 18 and lower end 48 of guide member 46. Bottom spacer 61 need only have the desired length the aerator 18 should be spaced above the bottom whenever the system is out of operation.

The air laterals 12,14 can be installed at any elevation within the basin. They can be ballasted on the bottom, floated on the surface or suspended anywhere in between.

Other special features of the retrievable aeration system include high efficiency fine-bubble aeration and mixing. The system can be installed in any basin regardless of whether the floor is level or able to support the weight of the ballast. The submergence of the aerator is controlled by the relative lengths of guide members 46 and spacers 56, which can be individually set for each location to account for unlevel basin floors or subsidence of the ballast blocks. The system may even be installed without removing water from the basin.

The aerators are easily retrieved and maintained without lifting the ballast. A substantial drawback of prior art retrievable systems is that the ballast for the aerator is integral with the unit, and the entire weight must be lifted to service a unit. Here, by removing stop member 54 from the upper end 50 of guide member 46 the aerator is disconnected from the ballast and easily raised to the surface.

For the same reason, replacement of the aerators is always to exactly the preselected location and elevation, since the ballast remains on the bottom during servicing. Yet, the aerators can be easily adjusted to different elevations whenever desired, merely by substituting a spacer 56 of different length.

All components, including air laterals, can float on the surface or be submerged to any preselected elevation. This allows air laterals to be set at an elevation high enough to drain water to the aerators while staying safely submerged below ice and other exposure problems such as vandalism and sunlight. The aerators are designed to continuously remove water during operation.

Individual aerators can be retrieved while the balance of the system remains in operation. System components are easily expanded or modified to meet changing requirements. The system is ideal for new construction, upgrades of existing lagoons, aquaculture, and sequencing batch reactors.

In contrast, prior art retrievable systems, such as the one shown in U.S. Pat. No. 4,563,277 to Tharp, require heavy ballast that is difficult for operators to lift and handle. The basin floor must be level so that all aerators operate at the same submergence. The elevation and orientation of aerators cannot be checked after the aerators have been retrieved and replaced. The construction of the basin, or rehabilitation of an existing basin, is expensive due to the requirement that the floor be level. If sedimentation occurs, lowering aerators to their original elevation and orientation is not possible.

Installation of the system "wet" is simple and straightforward:

1. Attach end of rope to ballast and lower ballast to floor of basin.

2. Pull vertically upward on the rope. When the rope is vertical above the ballast, note the point on the rope at which it intersects the water surface. Mark the stop member location on the rope at this point and make provisions for removable attachment of the float.

3. Float the aerator on the surface and connect it to the rope by running it through the yoke ring of the aerator, then attach the float.

4. When all the aerators are floating on the surface with their yoke rings connected to the ropes, review the layout and adjust as necessary. Tighten any loose ropes by adjusting the stop members. The aerators are now ready to be submerged.

5. Attach an extension cable (as described in my U.S. Pat. No. 5,690,864) to the top of the rope and run the extension cable through the tubular spacer. The extension cable can now be used to pull the rope through the tubular spacer.

6. Push the tubular spacer down the rope toward the ballast while pulling the rope upward through the end of the tube. This pushes the yoke ring of the aerator down.

7. When the rope stop exits the tube of the tubular spacer, attach the float to the top and remove the extension cable. This completes installation. The yoke ring is below the surface a distance equal to the length of the tubular spacer, and the aerator floats up whatever short distance the slack in the yoke, by its being longer than the aerator, allows.

Installation in a dry basin is similar, except that (a) all of the ballast must be at the same elevation, or (b) the elevation of each ballast must be measured and each rope be made to proper length or (c) final attachment of the floats must wait until the basin is filled.

If future changes in aerator operating depth are desired, the lengths of the tubular spacers can be increased or decreased by adding an additional section of spacer.

To remove the aerators for maintenance and inspection, attach the cable extension, remove the float and allow the aerator to float the to the surface.

The easiest way to install so that all components are beneath the surface is to lower the water surface, install the equipment as though it were intended to float and then submerge the equipment by raising the water level. This requires that the water level be lowered for floating air laterals.

Whereas, the present invention has been described with respect to specific embodiments thereof, it will be understood that various changes and modifications will be suggested to one skilled in the art, and it is intended to encompass such changes and modifications as fall within the scope of the appended claims.

I claim:

1. An aeration system for a wastewater treatment plant, comprising:

an air supply pipe for receiving compressed air;

the air supply pipe having a plurality of outlet;

a flexible air supply conduct extending from each outlet to an elongate aerator having ends;

an end fitting connected to the aerator at each end thereof, with a means in each end fitting for defining an attachment location;

a yoke longer than the aerator and having two ends, one end fixed to each attachment location;

the yoke also having a central yoke ring;

a guide member having lower and upper ends, the guide member being loosely interfitted with the yoke ring to permit relative movement between the aerator and guide member;

the lower end of the guide member being fixed with respect to the bottom of the wastewater treatment basin;

the upper end of the guide member being attached to a stop member; and a space for the aerator, the spacer having upper and lower ends, the upper end contacting the stop member and the lower end contacting the yoke ring, such that the aerator is positioned away from the stop member by the space, with the aerator being repositionable by removing the spacer from the guide member or by changing the length of the spacer.

2. The system of claim 1 where the air supply pipe is horizontal.

3. The system of claim 2 with the air supply pipe being vertically spaced apart from a wastewater treatment basin floor.

4. The system of claim 1 with the guide member lower end being attached to a ballast member on the basin floor.

5. The system of claim 1 with the stop member including a float.

6. The system of claim 1 with a bottom spacer located beneath the aerator, the bottom spacer having upper and lower ends, the upper end contacting the yoke ring when the air supply is removed, the lower end being fixed with respect to the guide member lower end, such that the yoke ring is vertically positioned from the guide member lower ends by the bottom spacer when the system is out of operation.

7. The system of claim 1 with an extension guide member interposed between the guide member and the stop member to permit removal of the spacer.

* * * * *